US005150698A

United States Patent [19]

Kohler et al.

[11] Patent Number: 5,150,698

[45] Date of Patent: Sep. 29, 1992

[54] METHOD AND ARRANGEMENT FOR ADJUSTING FUEL FOR EMERGENCY OPERATION

[75] Inventors: Rolf Kohler; Alfred Kratt, both of Schwieberdingen; Klaus Franzke, Leonberg, all of Fed. Rep. of Germany

[73] Assignee: Robert Bosch GmbH, Stuttgart, Fed. Rep. of Germany

[21] Appl. No.: 671,879

[22] PCT Filed: Oct. 5, 1989

[86] PCT No.: PCT/DE89/00635

§ 371 Date: Apr. 15, 1991

§ 102(e) Date: Apr. 15, 1991

[87] PCT Pub. No.: WO90/04092

PCT Pub. Date: Apr. 19, 1990

[30] Foreign Application Priority Data

Oct. 15, 1988 [DE] Fed. Rep. of Germany ..... 3835282

[51] Int. Cl.[5] ..... F02D 41/72; F02D 41/34; F02D 41/78

[52] U.S. Cl. ..... 123/690; 123/479

[58] Field of Search ..... 123/479, 440, 489; 364/431.11

[56] References Cited

U.S. PATENT DOCUMENTS 3,952,710 4/1976 Kawarada et al. ..... 123/489

FOREIGN PATENT DOCUMENTS 234584 9/1987 European Pat. Off. .
3714245 11/1987 Fed. Rep. of Germany .
32919 3/1980 Japan ..... 123/479
51924 3/1982 Japan ..... 123/479

OTHER PUBLICATIONS

Patent Abstracts of Japan, vol. 8, No. 124 (M-301), Jun. 1984.

Patent Abstracts of Japan, vol. 11, No. 10 (M-552), Jan. 1987.

*Primary Examiner*—Tony M. Argenbright
*Attorney, Agent, or Firm*—Walter Ottesen

[57] ABSTRACT

A method is disclosed for adjusting the amount of fuel to be supplied to an internal combustion engine in the case of non-idling operation even when the load signal fails. A plurality of emergency injection times are used which are modified with the manipulated variable of a lambda controller so that an injection time period is associated with each emergency injection time. The injection time periods are arranged such that they cover essentially all the injection times which can occur during the operation of an internal combustion engine. In the method, the lambda control remains switched on and the point at which control is to occur is found by running through the injection time periods. An arrangement for carrying out the method is also disclosed.

11 Claims, 3 Drawing Sheets

NEZ = EMERGENCY INJECTION TIME
LLK = IDLING CONTACT (CLOSED IN IDLING MODE)

LLK = IDLING CONTACT (CLOSED IN IDLING MODE)

n = ENGINE SPEED nUNT = LOWER ENGINE SPEED THRESHOLD

METHOD AND ARRANGEMENT FOR ADJUSTING FUEL FOR EMERGENCY OPERATION

FIELD OF THE INVENTION

The invention relates to a method and an arrangement for adjusting the amount of fuel to be supplied even in an emergency operation to an internal combustion engine, which has a lambda controller and an idling contact. The emergency operation concerns a situation, in which the load signal used in normal mode for determining the amount of fuel, fails.

BACKGROUND OF THE INVENTION

If, in conventional fuel amount setting arrangements for internal combustion engines, the load signal fails, this is detected by a means which tests the presence of this signal and in response, the means switches over from normal mode to emergency operation mode. In the emergency operation mode, a plurality of permanently predetermined emergency injection times are used in dependence upon certain operating states. Since the necessary fuel requirement, however, depends to a large degree on the load, the same amount of fuel at, for example, a certain engine speed leads to widely varying lambda values in dependence upon the operating conditions present in each case. The error in the fuel metering can be so large that the intake air/fuel mixture can no longer be ignited. Thus, a large degree of environmental damage may arise due to fuel which has not been combusted at all or only incompletely combusted. In addition, the catalytic converter present in lambda-controlled systems is damaged if it has reached its working temperature and a non-combusted mixture reaches it.

Japanese patent publication 59 028 030 describes a process which permits the emergency operation of an internal combustion engine in the event of the failure of the air-flow sensor. Within the scope of this process, only a basic injection time is used for metering the amount of fuel. This basic injection time is essentially multiplied by the reciprocal value of the engine speed and, in addition, contains signals of an idling switch and of an air/fuel ratio sensor.

A process for lambda control, which, even in normal operation, has no special sensor for detecting a load signal is disclosed in German patent publication DE-OS 3,714,245. In the process described, the detection of a load signal (air-flow measuring component) is dispensed with in order to reduce the complexity of the control arrangement. The fuel metering signal is formed as a function of the difference of a lambda actual value and of a lambda desired value. The lambda desired value is taken from a memory from a stored characteristic field as a function of the engine speed and an air-flow value. The air-flow value is, in turn, computed from the lambda actual value and the fed-back fuel metering signal.

SUMMARY OF THE INVENTION

The invention is based on the object to provide a method for emergency operation lambda control which permits even in emergency operation to always provide an ignitible mixture.

Furthermore, the invention is based on the object of specifying an arrangement for carrying out such a method.

The method of the invention is for setting the amount of fuel to be metered to an internal combustion engine having a lambda controller and an idling contact during normal operation as well as during emergency operation wherein the load signal, which coacts during normal operation for determining the amount of fuel, is not available, and for the condition of non-idle operation and with the lambda probe in operational readiness.

A first embodiment of the method of the invention includes the steps of: predetermining at least one emergency injection time; forming an output variable of a lambda controller for the difference between the lambda actual value and a lambda desired value; modifying each injection time with the output variable of the lambda controller thereby forming an injection time duration having a width dependent upon the selected maximum amplitude of said output variable; selecting the number of injection time durations and the maximum amplitude of said output variable so as to cause the injection time durations to cover all injection times which can occur during operation of the engine; and, in the case of the presence of at least two emergency injection times, if one of the ends of the time duration associated with the emergency injection time actually present is reached, switching over to the next time period lying in the direction of this end.

This first embodiment of the invention is distinguished in that, in the case of non-idling, at least one emergency injection time is permanently predetermined and that each emergency injection time is modified with the manipulated variable of the lambda controller. As a result, an injection time period arises the width of which depends on the selected maximum amplitude of the output signal of the lambda controller. Here, the width of an injection time period is understood to mean the difference between the longest and the shortest injection time within the time period. The number of the emergency injection times, and thus of the injection times and the maximum amplitude of the output signal of the lambda controller, are selected such that the injection time periods cover all the injection times which can occur during the operation of an internal combustion engine. Then, if one of the ends of the time period associated with the emergency injection time actually present is reached, switching over occurs to the next emergency injection time lying in the direction of this end.

With this method, the lambda controller thus remains continuously active. The switching over between the emergency injection times corresponds to the attempt to obtain such an injection time as a preset value which deviates from the correct injection time to reach the lambda value 1 by, at maximum, the setting range of the lambda controller. If the, in this respect, correct emergency injection time is found, the lambda controller can control as if normal mode were present. However, it is advantageous not to operate the lambda controller in emergency operation mode exactly the same as in normal mode, but rather to increase the setting speed. This is the case, so that, if a plurality of emergency injection times are to be selected successively and the respectively associated time periods are to be run through, this running-through occurs in as short a time as possible. The setting speed must, however, not be so high that undesired hunting occurs.

With further developments of the method according to the invention it is possible to achieve a satisfactory control even in special situations. For example, the case can arise that, starting from a high load and thus long injection time, the load is suddenly reduced to such an extent that the mixture, which is then too rich, no longer ignites properly. Oxygen is then present in the exhaust gas, which leads to an adjustment being made not in the lean direction but rather in the rich direction, although the mixture is already too rich. In order to solve this problem, according to an advantageous development, switching over occurs to the shortest emergency injection time when the long end of the time period associated with the longest emergency injection time is reached. As a result, the lean mixture required for the example is set. Another problem case consists in that a mixture, which can be ignited, cannot be set with the aid of the method in, for example, the overrun operation which has not (yet) been detected. As a result, excessively lean mixture is continuously indicated regardless of the selected injection time.

According to another advantageous development, in order to solve this problem, the fuel supply is completely cut off if the entire injection time range has been run through once in one direction; the rebound from the longest to the shortest emergency injection time is not interpreted as a reversal of direction. Various conditions determine when the fuel supply is restored, for example after a predetermined time period has elapsed. The time period is, in particular, selected in such a way that the catalytic converter, which heated up due to the post-combustion of a non-combusted air/fuel mixture, can cool down again sufficiently.

The previously described measures serve for setting the lambda value 1 or for cutting off the fuel supply in order to protect the catalytic converter from overheating. Further developments of the emergency operation method according to the invention, however, also permit to temporarily set rich mixtures, as are set even in normal mode for example during the acceleration process. Such an enrichment is achieved by compulsorily selecting a long emergency injection time. The compulsory selection of such a time occurs advantageously when an opening of an idling contact is detected. If the idling contact was only closed for a short time, for example during a switching process, the long emergency injection time is selected and then the control process is immediately released. In contrast, if the idling contact was closed for a longer time, the long emergency injection time is inhibited for a predetermined acceleration time period before the control process is released. As additional condition for the taking up of the inhibit measure, it is advantageously provided that the motor speed lies below a threshold speed which is the upper limit for idling operation. If this condition is fulfilled and the idling contact closes after a longer time, this is a good starting point from which acceleration should take place, which usually means an acceleration over several seconds.

According to an additional embodiment of the method of the invention, when the idling contact has been closed for longer than a predetermined time duration, the function of the lambda controller is blocked for a predetermined acceleration time period, in order to maintain the long emergency time in this acceleration time duration.

This additional embodiment of the method of the invention assumes an emergency operation setting in the case of idling. It can be used together with a conventional emergency operation mode for the case of non-idling, but is preferably used together with the first embodiment of the method of the invention. In the case of idling, even when a high setting speed is set, a lambda controller reacts too sluggishly to be able to set constantly a mixture composition which guarantees a continued running of the internal combustion engine. With conventional methods, therefore, fuel is continuously metered in emergency operation with a single permanently predetermined injection time. According to the the additional embodiment of the method of the invention, in contrast, the injection time is predetermined in such a way that it changes essentially in an inverse relationship to the engine speed starting from a standby injection time. This occurs preferably in that the injection time is acquired from a conventional engine speed/load/injection time characteristic field, to which, as load value, a permanently predetermined standby load value is continuously fed. If the lambda probe is not yet ready for operation, the injection time thus calculated is the injection time actually used. If, in contrast, the probe is ready for operation, the injection time thus calculated serves as preliminary injection time which is then fine-tuned with the aid of a superimposed lambda control.

The additional embodiment of the method of the invention thus concerns an emergency operation method for the case of idling, in which, in the basic design, it is unimportant whether a lambda probe which may be present is ready for operation or not. The emergency operation method according to the first embodiment concerns by contrast the case of non-idling with the probe ready for operation. In the case of non-idling with the probe not ready for operation, a conventional emergency operation method is used. Therefore, for example the engine speed is measured and, as a function of the respectively present engine speed range, one of a plurality of permanently predetermined emergency injection times is used, each of these times being associated with a certain engine speed range.

An arrangement according to the invention has a means for storing preferably a plurality of emergency injection times and a means for modifying each emergency injection time with the manipulated value of the lambda controller. In addition, a means is present for switching over the respectively present emergency operation injection time to the next shorter or the next longer one according to the above-mentioned considerations. The arrangement according to the invention is preferably implemented by means of a correspondingly programmed microprocessor.

BRIEF DESCRIPTION OF THE DRAWINGS

The invention is described in more detail below with reference to exemplary embodiments illustrated by figures, wherein.

DESCRIPTION OF THE PREFERRED EMBODIMENTS OF THE INVENTION

Figure 1:
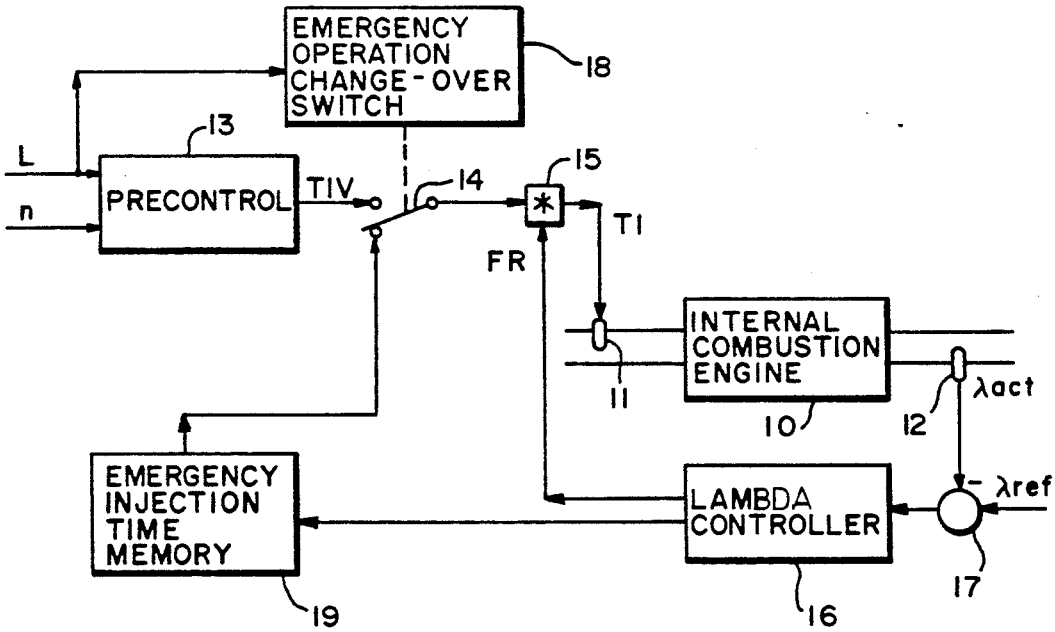
FIG. 1 shows a function diagram of an emergency operation lambda control represented as block circuit diagram, the emergency lambda control operating with a plurality of emergency injection times.

The method explained with reference to FIG. 1 serves for setting the injection time of an internal combustion engine (BKM) 10. The injection occurs via an injection valve arrangement 11. Below, always only one single injection valve is referred to. However, this should not mean that the arrangement could not have a plurality of valves. For each valve, the same applies as is said with reference to the one valve. In the exhaust gas channel of the internal combustion engine 10, a lambda probe 12 is arranged. All the other function groups represented in FIG. 1 and described below belong to an arrangement which is preferably implemented by means of a microprocessor with a corresponding program.

As long as no emergency operation situation has occurred, a respective preliminary injection time TIV is issued from a means 13 for precontrol as a function of the respectively present value of a load variable L and the respectively present engine speed. This injection time passes via a switching means 14 to a multiplier stage 15 where it is multiplied with a control factor FR in order to form the actual injection time TI. The control factor FR is the manipulated variable of a means 16 for controlling. The manipulated variable is formed in that the actual value measured by the lambda probe 12 is subtracted in a subtracting stage 17 from a lambda desired value and the control deviation thus formed is processed in a conventional manner according to a PI-control method. If the control deviation is 0, the control factor FR is 1. If the lambda actual value is, for example, 5% higher than the lambda reference value, the control factor is increased by 5%, thus it is set to 1.05. This does not occur in one step, but rather as a function of the integration speed of the means 16 for controlling, also referred to as lambda controller, within a certain time period.

If the load variable L fails, no further relevant preliminary injection times TIV can be issued by the means 13 for precontrol. In order to operate the internal combustion engine 10 nevertheless satisfactorily, the arrangement according to FIG. 1 also has an emergency operation change-over switch 18 and an emergency injection time memory 19, in which, for example, four different emergency injection times are stored. The emergency operation change-over switch 18 continuously monitors the presence of the load signal. As soon as this signal fails, the emergency operation change-over switch 18 actuates the switching means 14, as a result of which the latter switches the input of the multiplier stage 15 to the output of the emergency injection memory 19, thus away from the output of the means 13 for precontrol. Which emergency injection time is to be read out of the emergency injection time memory 19 is determined via an addressing by the means 16 for controlling.

The purpose served by the four emergency injection times is now explained in greater detail with reference to FIG. 2. In the diagram according to FIG. 2, four injection time periods are represented which, for the sake of clarity, are drawn offset from one another from left to right. The center point of each injection time period corresponds to one of four emergency injection times A, B, C and D which are dimensioned in the exemplary embodiment as 1 msec, 1.5 msec, 2.25 msec and 3.4 msec. Each time period extends from the associated emergency injection time by 50% upwards and downwards corresponding to a stroke of the means 16 for controlling of 50%. Each emergency injection time is arranged such that it coincides with the end of the time period associated with the next shorter emergency injection time. The shortest possible injection time which is required for setting the lambda value 1 corresponds to the short end of the time period associated with the shortest emergency injection time, thus lying at 0.5 msec. This shortest injection time is designated in FIG. 2 by K. The corresponding longest injection time to reach the lambda value 1 is designated by L. In the exemplary embodiment, this time is 4.2 msec. The time period associated with the longest emergency injection time D, however, extends beyond this longest injection time L up to 5.1 msec in the exemplary embodiment. The reason for this is explained further below.

In order to explain the emergency operation method which can be carried out with the aid of these emergency injection times and the associated time periods, it is assumed that a first load point with an associated injection time L1 is present. The injection time L1 is assumed to be correctly set. Now, the driver steps on the accelerator such that for this load status, in order to reach the lambda value 1, an injection time is required which is designated in FIG. 2 by L2. As long as the load signal is correctly detected, the approximately correct precontrol time is issued by the means 13 for precontrol and finely corrected in the multiplier stage 15. However, if the load signal is absent, the load change caused by the driver is not immediately detected. However, the acceleration by the driver leads to the mixture being made leaner, since the throttle flap is opened, but the injection time is not increased at the same time. If the lambda controller 16 detects too lean a mixture, it increases the control factor FR, as a result of which the injection time grows starting from the value L1. This growth comes initially to an end when the maximum amplitude of the output signal of the lambda controller 16 is reached at the injection time C. The lambda controller 16 indicates the reaching of this end to the emergency injection time memory 19 with a corresponding addressing for the purpose of reading out the emergency injection time C. The lambda controller 16 is at the same time set to the center of the setting range, therefore in the example to the control factor 1. However, since the mixture is still too lean because the emergency injection time C lies considerably below the injection time L2 required for the new load status, the lambda controller 16 integrates further upwards within the time period associated with the emergency injection time C until it again reaches the end of its maximum amplitude of the output signal of the lambda controller, this time at the emergency injection time D. Now, the emergency injection time memory 19 is actuated so that it issues the mentioned emergency injection time D. The control factor is then again set from 1.5 to 1. However, since the emergency injection time D also still lies below the required injection time L2, the lambda controller 16 integrates further upwards. If it then reaches the injection time L2, conventional closed-loop control occurs around this injection time.

It is assumed that, after some time, the driver takes his foot off the accelerator pedal again and to such an extent that precisely the original injection time L1 is again required to set the lambda value 1 for the new load status. Because of the long injection time L2, which is initially still set, the mixture is too rich. The lambda controller 16 then regulates completely downwards within the time period associated with the longest emergency injection time D. As soon as the lower end is reached, the lambda controller 16 addresses the emergency injection time memory 15 such that the latter now issues the shorter emergency injection time C. At the same time, the control factor is changed from 0.5 to 1. This leads to a slight increase in the injection time at the jump from the time period associated with the emergency injection time D to the other time period associated with the emergency injection time C. This rise is recognizable from the dot-dash line on the far right. Since the required injection time L1 still lies below the emergency injection time C, the mixture is still too rich, for which reason the lambda controller 16 integrates further in the direction of shorter injection times until finally the required injection time L1 is reached. The conventional closed-loop control then occurs again around this injection time.

From the above it becomes clear that with the aid of the four emergency injection times and the associated time periods, each injection time can be set which leads to the lambda value 1. So that the new associated injection time is found relatively quickly after a load change, it is suitable to set the integration speed of the lambda controller 16 as high as possible, but only so high that undesired strong hunting does not arise when the controlling occurs around the injection value associated with a respective load status.

As explained above, a rich mixture suddenly occurs if the driver lifts his foot off the accelerator but the long injection time is still set for the previously present high load status. The enrichment can be so strong that ignition misfires occur. Then, there is still oxygen in the exhaust gas which leads to the probe indicating lean mixture, although the mixture is far too rich. If no further measure is taken, this would then lead, according to the previous method sequence, to the injection time running up to the upper end of the time period associated with the long emergency injection time D, therefore in the example up to the injection time of 5.1 msec, and then remaining there, although a very short injection time would be required in order to be able to set the lambda value 1 again. In order to achieve this, the lambda controller 16 addresses the emergency injection time memory 19, according to an advantageous development in such a way that, at the mentioned reaching of the longest injection time, a switching over occurs to the shortest emergency injection time A and at the same time the lambda controller 16 sets the control factor FR to 1.

It will now be explained why the longest settable injection time lies above the longest injection time which is required to set the lambda value 1. For the sake of illustration, it is assumed that a load change is carried out which requires the longest injection time for the lambda value 1, thus the injection time L. If this injection time is reached by corresponding large-scale integration of the control factor FR, this is, however, not immediately detected by the lambda probe 12, since there is a considerable dead time between the time of the injection of fuel by the injection valve arrangement 11 and the detection of the associated lambda value by the lambda probe 12. If, in the mentioned dynamic case, the correct injection time is reached, the lambda probe still measures the excessively lean mixture which was injected a short time previously. If now the upper end of the time period associated with the longest emergency injection time D were to coincide with the injection time L, according to the above-described switch-over function, the shortest emergency injection time A would now be switched to. However, this is avoided if the time period associated with the emergency injection time D extends beyond the injection time L. The described dynamic effect is considerably further amplified, especially in cold engines, in that initially a wall film is to be constructed when increasing the amount of fuel to be supplied. In order to avoid in all these cases a switching over from the longest to the shortest emergency injection time, it is suitable to set the longest settable injection time to be approximately 20 to 30% higher than the longest injection time with the purpose of achieving the lambda value 1.

In the method sequence illustrated with reference to FIG. 2, time periods are used which are arranged in such a way that the center of each time period coincides with the end of the time period extending to shorter times. However, this does not necessarily have to be the case. It is only necessary for the time periods to cover all required injection times. The fewest emergency injection times with associated time periods are then required, if the short end of each time period joins the long end of another time period. However, this is impractical, since if control is to occur precisely around an injection time which lies at the end of a time period, switching over must occur continuously from one emergency injection time to the adjacent one and the control factors must be correspondingly switched over in each case.

Figure 3:
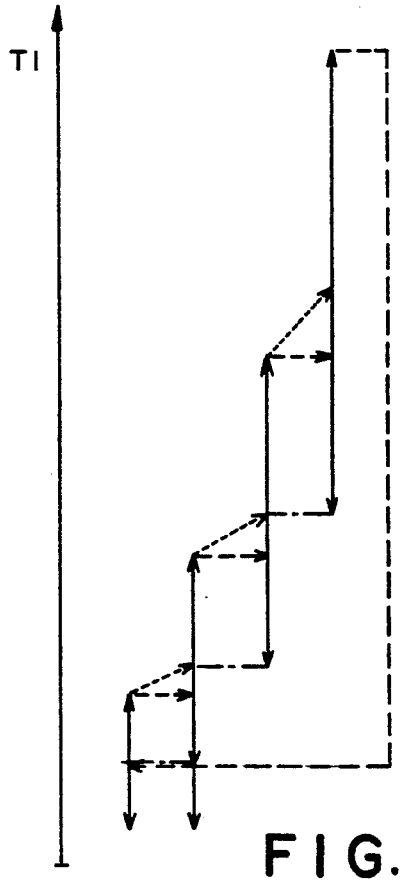

The overlapping of time periods represented in FIG. 3 is particularly suitable. Here, the lower end of each time period coincides with the center of the adjacent time period extending to shorter injection times. If the upper end of a time period is reached, essentially two possibilities exist for switching over to the next time period. The one possibility is shown by dotted lines in FIG. 3. It consists in switching over to the next higher emergency injection time and changing the control factor from 1.5 to 1. In this case, a steep torque moment increase is associated with the switch-over. This can be avoided if it is calculated to which value the control factor FR must be set after the switch-over in order to achieve the same injection time starting from the new, higher emergency injection time, as was present previously when the long end of the other time period was reached. This switch-over possibility is entered as dashed lines in FIG. 3.

Figure 2:
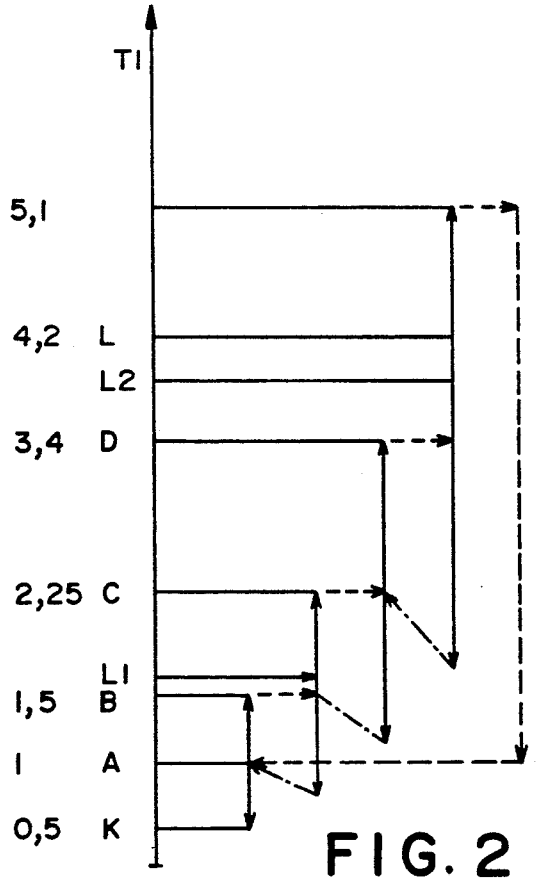
FIGS. 2 and 3 show diagrams for the illustration of two methods for the successive selection of emergency injection times.

In the exemplary embodiment of FIGS. 2 and 3, it was assumed that the maximum amplitude of the output signal of the lambda controller 16 is 50%. However, the maximum amplitude of the output signal can assume any other value. The higher the maximum amplitude of the output signal, the fewer the emergency injection times with associated time periods which are required in order to cover the entire required injection time range.

Figure 4A:
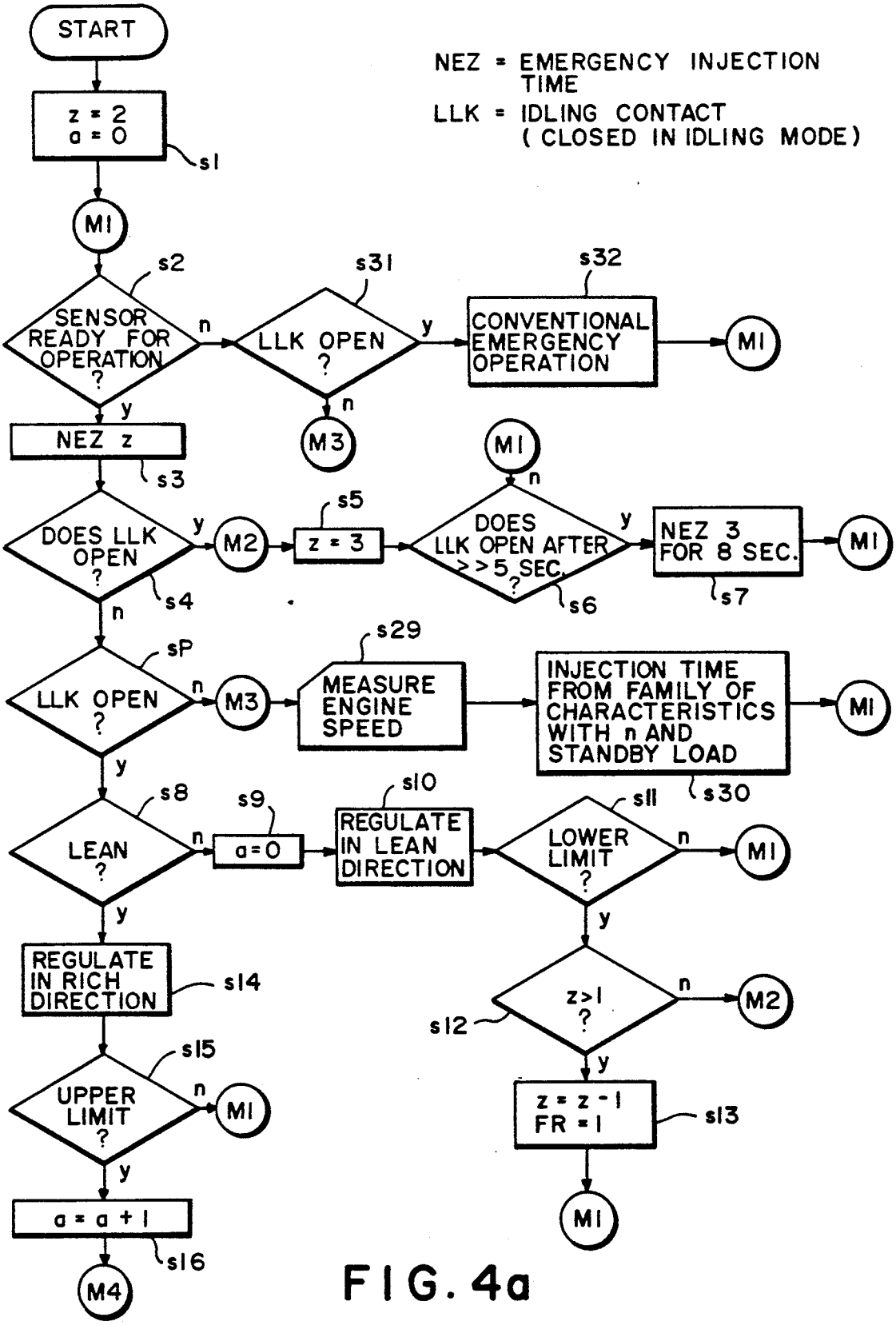
FIGS. 4*a* and 4*b* show a flow diagram for explaining an emergency operation lambda control with four emergency injection times.
Figure 4B:
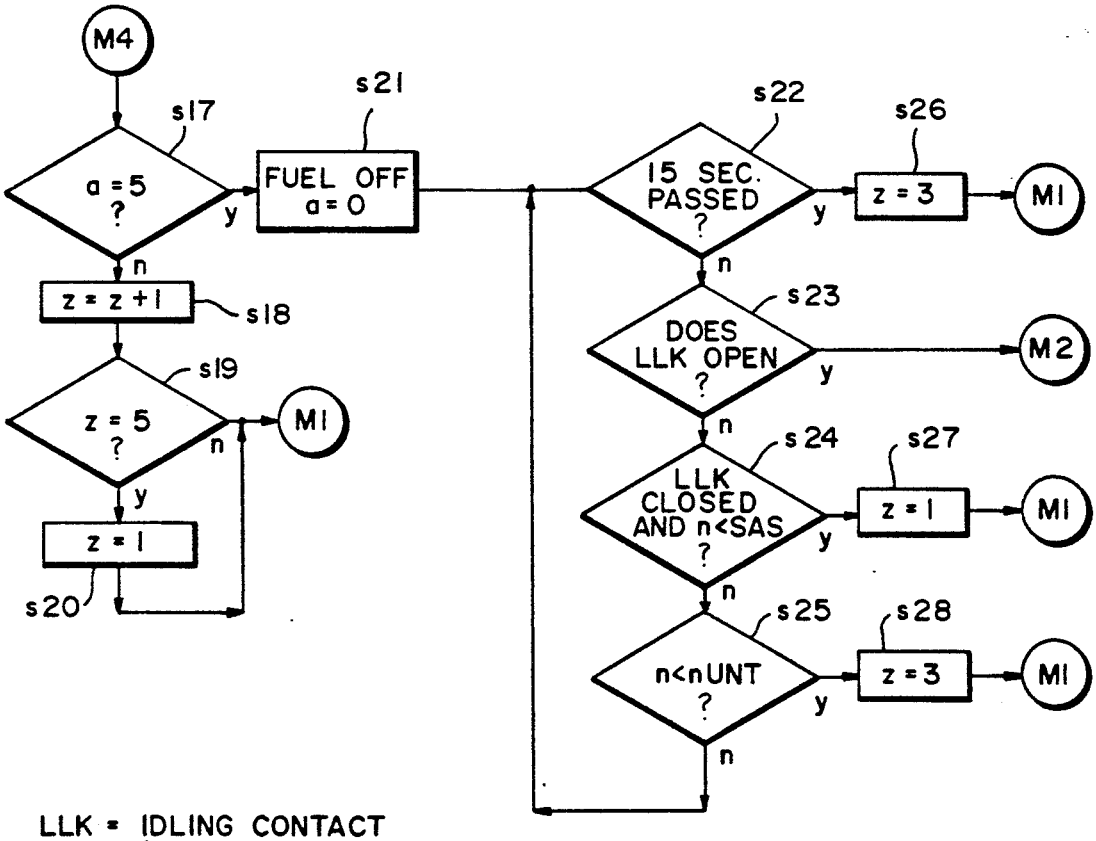

The method described until now with the specified and also other developments is now explained in another manner, namely in the form of a flow diagram, with reference to FIG. 4.

For the starting point of the flow diagram according to FIG. 4, it is assumed that the emergency operation change-over switch 18 has detected the emergency operation situation and the emergency operation method is started in a starting step. In a step s1, two parameters are set, that is one parameter z to the value 2 and one parameter a to the value 0. The respective value of the parameter z indicates which of four emergency injection times NEZ z is selected in each case. The value z=2 signifies that the second emergency injection time is set, corresponding to the emergency injection time B of FIG. 2. The parameter a indicates how many time periods have been successively run through in the rich direction without a turnaround occurring in the lean direction.

After a mark M1, a step s2 follows, in which it is tested whether the probe is ready for operation. If this is the case, the emergency injection time corresponding to the value of the parameter z is set in a step s3.

In a step s4, it is interrogated whether the idling contact LLK arranged at the throttle flap control opens. If this contact opens, this is a sign that the driver has stepped on the accelerator, therefore, in some manner or another wishes to accelerate. In order to achieve a satisfactory transition, however, a mixture enrichment is always required beyond the lambda value 1. Correspondingly, the parameter z is set to 3 in a step s5, if opening of the idling contact is detected in step s4. This leads to the setting of the emergency injection time 3, (corresponding to emergency injection time C in FIG. 2). How long this enrichment is to be carried out, is decided in step s6, in which it is tested whether the idling contact only opened after a stay time period of more than 5 seconds or even earlier. If it only opened after more than 5 seconds, in a step s7 it is ensured that the emergency injection time 3 is maintained for an acceleration time period of 8 seconds. Then the mark M1 is reached. If, in contrast, the idling contact opened after less than 5 seconds closing time, the approach to the mark M1 follows step s6 directly. The selection of the acceleration time period when the closing time of the idling contact exceeds the stay time period is based on the consideration that when the engine was operated for a relatively long time in the idling mode and then the acceleration is stepped up, usually a motor vehicle acceleration is desired starting from standing. In all other operating states, for example when switching, the idling contact is only closed for a relatively short time. However, the contact can also be closed for a relatively long time in overrun phases. Therefore, it can be advantageous to test, additionally to the condition according to step s6, whether, before the opening of the contact, the engine speed was in a range which indicates idling. Only if this additional condition is fulfilled, is the long emergency injection time 3 blocked for the duration of the acceleration time period.

If it is detected in a step s4 that the idling contact did not open, it is tested in a step sP whether it is still open or closed. If it is open, there follows the method sequence described with reference to FIGS. 2 and 3. Namely, it is tested in a step s8 whether the lambda probe indicates lean mixture. If this is not the case, the above-mentioned parameter a is set to 0 in a step s9. In a step s10, control occurs in the lean direction. In a step s11, it is tested whether the lower limit of the time period associated with the emergency injection time actually present is reached. If this is not the case, the sequence returns to the mark M1. If this is the case, a step s12 follows in which it is tested whether the parameter z is >1. If this is not the case, the shortest emergency injection time has therefore already been set, the method returns without further measure to the mark M1. Otherwise, the parameter z is set to the next shorter emergency injection time in a step s13 and the control factor FR is switched over as described above. Then, the method returns likewise to the mark M1.

If it is detected in a step s8 that excessively lean mixture is present, control in the rich direction occurs in a step s14. In a step s15, it is tested whether the upper limit of the time period associated with the current emergency injection time has been reached. If this is not the case, the method returns to the mark M1. If, in contrast, this is the case, the parameter a is increased by 1 in a step s16. In a step s17, it is tested whether it has reached the value 5, that is whether all four time periods were run through in the rich direction without, in between, controlling occurring in the lean direction (then, a would have been reset to 0 in step s9). If this is not the case, in a step s18, the parameter z is increased in order then to set the next higher emergency injection time in step s3. First, however, it is tested in a step s19 whether the parameter z has already reached the value 5, is therefore at a higher value than there are emergency injection times provided. If this is not the case, mark M1 is directly returned to. If, in contrast, this is the case, the parameter z is set to 1 in a step s20 in order to pass from the longest emergency injection time to the shortest, as explained with reference to FIG. 2. After this setting, the method returns to the mark M1.

If it is detected in step s17 that the parameter a is at the value 5, that is that all four time periods were successively run through only in the rich direction, the fuel supply is switched off in a step s21, since in this case it is to be assumed that an ignitible mixture cannot be set. If, nevertheless, further fuel is supplied, the non-combusted fuel in the catalytic converter would be combusted, which leads to a considerable temperature increase there and thus to destruction. In addition, in s21, the parameter a is set to 0.

After the cutting off of the fuel supply in step s21, it is tested in four successive steps s22 to s25 whether one of four conditions for the resumption of the fuel supply is fulfilled. In step s22, it is tested whether a switch-off time period of 15 seconds has passed since the switching off. If this is the case, in a step s26, z=3 is set and the method returns to the mark M1. If this is not the case, it is tested in a step s23 whether the idling contact opens. If this is the case, the method returns to a mark M2 which is located between the steps s4 and s5. If this is not the case, with closed idling contact there is a drop below an overrun switch-off engine speed. If this is the case, z=1 is set in a step s27 and the method returns to the mark M1. If this is not the case, there follows finally in step s25 the test as to whether a further engine speed threshold of, for example 1,200 rpm has been undershot. If this is not the case, there occurs again from step s22 the testing of the switch-on conditions. However, if this is the case, z=3 is set in a step s28 and the method returns to the mark M1 in order to supply fuel again in a controlled manner so that the internal combustion engine does not cease to operate.

In the exemplary embodiments, it was assumed that the manipulated value of the lambda controller multiplicatively (control factor FR) modifies injection times. In this case, at the control deviation 0 the manipulated value is 1 and it fluctuates with a maximum amplitude of the output signal of the lambda controller of 50% between 0.5 and 1. The manipulated value can, however, also modify injection times additively. In this case, its value is 0 at the control deviation 0. With control deviations present, it assumes positive or negative values, with a maximum amplitude of the output signal of 50% referring to the respectively present reference value.

Above, it was specified that, at the transition from a time period, which is associated with a first injection time, to a time period, which is associated with an adjacent emergency injection time, it is suitable to construct the transition in such a way that the effective injection time remains unchanged in order to thereby avoid torque jumps. This is beneficial for driving comfort. If, in contrast, the noxious substance emission is to be kept as low as possible, the run-through, which may be required, through all possible injection times must occur as quickly as possible. Then it is suitable to tolerate injection time jumps when switching the emergency injection times. However, in this regard, it must always be ensured that the jump is not so large that the two injection times before and after the jump do not each set a lambda value which lies outside the ignition limits in the case of excessively rich or excessively lean mixture.

All the exemplary embodiments were based arbitrarily on four emergency injection times. It is pointed out once more that the number of emergency injection times, the magnitude of the maximum amplitude of the output signal of the lambda controller and the type of the transitions from one time period to the other are insignificant with respect to the basic principle of the described emergency operation method. It is only important that the time periods are selected according to number and maximum amplitude in such a way that they cover all the injection times occurring in practice. If the controller amplitude is selected to be very large, it is sufficient to use only a single emergency injection time. Even then, the principle is still fulfilled in that not, as conventionally, only a few fixed emergency injection times are present, but rather that, supported on the manipulated value of the lambda controller, in each case that injection time is set which leas to the desired lambda value.

The entire description of FIG. 4 up to now explained only the emergency operation method for the case of non-idling already described theoretically with reference to FIGS. 2 and 3. A completely different method is used in the case of idling. This method is now explained starting from step sP.

If it is detected in the step sP, that the idling contact is closed, this is a sign that the internal combustion engine is operated in the idling mode. In a step s29, the engine speed is measured and in a step s30, a characteristic field is selected with the aid of the measured engine speed and a fixed standby load value, and from said characteristic field, the injection time associated with the mentioned values is read out. The method then returns to the mark M1.

The determination of the injection time in step s30 can also occur, for example, in that a standby injection time is fixed for a reference engine speed of, for example 1,200 rpm and this standby injection time is multiplied by the quotient of reference engine speed to measured engine speed. Step s30 is, in any case, to be constructed in such a way that the injection time rises quickly when the engine speed falls.

If the internal combustion engine on which the mentioned idling emergency operation method is carried out has a lambda controller, it is suitable to use the injection time determined in step s30 as precontrol injection time which is then fine-tuned by the manipulated value of the lambda controller. Despite this fine tuning, the method reacts quickly, since the injection time used as precontrol value is determined quickly from the characteristic field or by calculation, using the actual measured engine speed.

The above-described emergency operation method for the case of idling can also be used if the probe is not yet ready for operation. If the absence of readiness for operation of the probe is detected in step s2, the method passes to a step s31, in which it is tested whether the idling contact is open. If this is not the case, idling is therefore present and the method goes to the mark M3, therefore the steps s29 and s30 follow with the transition to the mark M1. If, in contrast, the idling contact is open, a conventional emergency operation method is carried out in a step s32. The method then goes again to the mark M1.

The just described emergency operation method for the case of idling is included according to FIG. 4 in an overall sequence which also comprises the emergency operation method described at the beginning, for the case of non-idling with probe ready for operation. The idling emergency operation method just described can, however, also be used if a conventional emergency operation method is used for the case of non-idling with probe ready for operation.

It is pointed out that all the method sequences described can be carried out both with two-position controllers and with continuous-action controllers. If the methods are used in systems with adaptation, the adaptation is prohibited during the emergency operation.

We claim:

1. A method for setting the amount of fuel to be metered to an internal combustion engine having a lambda controller and an idling contact during normal operation as well as during emergency operation wherein the load signal, which coacts during normal operation for determining the amount of fuel, is not available, and for the condition of non-idle operation and with the lambda probe in operational readiness, the method comprising the steps of:

predetermining at least one emergency injection time;

forming an output variable of a lambda controller from the difference between the lambda actual value and a lambda desired value;

modifying each emergency injection time with the output variable of the lambda controller thereby forming an emergency injection time duration having a width dependent upon a selected maximum amplitude of said output variable;

selecting the number of emergency injection time durations and maximum amplitude of said output variable so as to cause the emergency injection time durations to cover all injection times which can occur during the operation of the engine; and, in the case of the presence of at least two emergency injection times extending over respective time spans with said time spans having respective ends, if one of the ends of the time span associated with the emergency injection time actually present is reached, switching over to the next time span lying in the direction of said one of said ends.

2. The method of claim 1, with the switch over to the next time duration, the output variable of the lambda controller is set so that the emergency injection time thus achieved essentially corresponds with the injection time valid before the switch over.

3. The method of claim 1, wherein a switch over occurs to a time near to the shortest emergency injection time when the longest emergency injection time is reached.

4. The method of claim 3, wherein, when all the emergency injection times have been successively run through in increasingly longer direction, without the lambda controller resetting the emergency injection time in a shorter direction, the fuel supply is completely cut off until a switch-on condition is fulfilled.

5. The method of claim 4, wherein the closing state of an idling contact is monitored and, on the opening of the idling contact, a long emergency injection time is set.

6. The method of claim 5, wherein, when the idling contact has been closed for longer than a predetermined stay time duration, the function of the lambda controller is blocked for a predetermined acceleration time period, in order to maintain the long emergency injection time in this acceleration time duration.

7. The method of claim 6, wherein the actuating speed of the lambda controller is increased when switching over from normal operation to emergency operation.

8. The method of claim 1, wherein, additionally, in the case of idling, the emergency injection time is predetermined in such a way that this emergency injection time changes essentially in inverse relationship to the engine speed starting from a substitute injection time.

9. The method of claim 8, wherein the emergency injection time is obtained from a conventional engine speed/load/injection time characteristic field, to which, as load value, a fixed predetermined substituted load value is continuously supplied.

10. The method of claim 1, wherein a switch over occurs to a time near to the shortest emergency injection time when the longest injection time is reached.

11. An arrangement for adjusting the amount of fuel to be metered to an internal combustion engine during normal operation as well as during emergency operation wherein the load signal, which is used in normal operation for adjusting the amount of fuel with the aid of a lambda controller, is not available, the arrangement comprising:

means for storing at least one emergency injection time;

means for modifying each emergency injection time with the output variable of the lambda controller for forming a particular emergency injection time duration with the overall width of said injection time duration covering all emergency injection times occurring during operation of the engine; and, means for switching over the emergency injection time present to the next shorter or to the next longer emergency injection time in the case of the presence of a plurality of emergency injection times and when the short or long end of the time duration associated with the present emergency injection time is reached.

* * * * *

UNITED STATES PATENT AND TRADEMARK OFFICE

CERTIFICATE OF CORRECTION

PATENT NO. : 5,150,698

DATED : September 29, 1992

INVENTOR(S) : Rolf Kohler, Alfred Kratt and Klaus Franzke

It is certified that error appears in the above-identified patent and that said Letters Patent is hereby corrected as shown below:

In column 2, line 12: delete "for" and substitute -- from -- therefor.

In column 3, line 59: between "predetermined" and "time", insert -- stay --.

In column 11, line 36: delete "leas" and substitute -- leads -- therefor.

Signed and Sealed this

Twelfth Day of October, 1993

*Attest:*

*Attesting Officer*

Bruce Lehman

BRUCE LEHMAN

*Commissioner of Patents and Trademarks*